US006902652B2

(12) United States Patent
Martin

(10) Patent No.: US 6,902,652 B2
(45) Date of Patent: Jun. 7, 2005

(54) MULTI-LAYER PAPERMAKER'S FABRICS WITH PACKING YARNS

(75) Inventor: Chad Aaron Martin, Menasha, WI (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/434,895

(22) Filed: May 9, 2003

(65) Prior Publication Data

US 2004/0221914 A1 Nov. 11, 2004

(51) Int. Cl.[7] ..... D21F 1/10; D03D 13/00

(52) U.S. Cl. ..... 162/348; 162/902; 162/903; 442/207; 139/383 A

(58) Field of Search ..... 162/204–207, 162/306, 348, 358.2, 900–904; 139/383 A, 425 A, 383 AA; 442/203–208

(56) References Cited

U.S. PATENT DOCUMENTS

| | | | | | |
|---|---|---|---|---|---|
| 3,851,681 | A | * | 12/1974 | Egan | 139/420 R |
| 4,379,735 | A | | 4/1983 | MacBean | |
| 4,501,303 | A | | 2/1985 | Osterberg | |
| 4,605,585 | A | | 8/1986 | Johansson | |
| 4,941,514 | A | | 7/1990 | Taipale | |
| 4,995,429 | A | * | 2/1991 | Kositzke | 139/383 R |
| 5,101,866 | A | * | 4/1992 | Quigley | 139/383 A |
| 5,152,326 | A | | 10/1992 | Vohringer | |
| 5,158,117 | A | * | 10/1992 | Huhtiniemi | 139/383 A |
| 5,164,249 | A | | 11/1992 | Tyler et al. | |
| 5,169,709 | A | | 12/1992 | Fleischer | |
| 5,366,798 | A | | 11/1994 | Ostermayer | |
| 5,613,527 | A | * | 3/1997 | Zimmermann et al. | 139/383 A |
| 5,641,001 | A | * | 6/1997 | Wilson | 139/383 A |
| 5,713,396 | A | | 2/1998 | Lee | |
| 5,826,627 | A | | 10/1998 | Seabrook et al. | |
| 5,865,219 | A | * | 2/1999 | Lee et al. | 139/383 A |
| 5,967,195 | A | | 10/1999 | Ward | |
| 6,092,298 | A | * | 7/2000 | Salminen et al. | 34/71 |
| 6,207,598 | B1 | * | 3/2001 | Lee et al. | 442/206 |
| 6,223,780 | B1 | * | 5/2001 | Kaldenhoff | 139/383 A |
| 6,276,402 | B1 | * | 8/2001 | Herring | 139/383 A |

FOREIGN PATENT DOCUMENTS

| | | |
|---|---|---|
| EP | 0 728 865 A | 8/1996 |
| JP | 6-4953 | 1/1994 |
| WO | WO 02/00996 A1 | 1/2002 |

* cited by examiner

*Primary Examiner*—Eric Hug
(74) *Attorney, Agent, or Firm*—Frommer Lawrence & Haug LLP; Ronald R. Santucci

(57) ABSTRACT

A papermaker's fabric, usable in the forming section of a paper machine, having a top layer and a bottom layer of cross-machine direction (CD) wefts. The top (forming) layer and bottom (wear side) layer are woven together to form a multi-layer fabric. CD packing yarns are inserted between adjacent wear side weft yarns. The packing yarns reduce the void volume on the wear side of the cloth without significantly disrupting the air permeability or increasing the caliper of the fabric. The placement of the packing yarns also adds to the CD stability and seam strength of the fabric and reduces the lateral movement of the wear side weft yarns.

11 Claims, 3 Drawing Sheets

MULTI-LAYER PAPERMAKER'S FABRICS WITH PACKING YARNS

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric usually woven from monofilaments and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface properties, but such design may lack the desired stability resulting in a short fabric life. By contrast, coarse mesh fabrics provide stability and long life at the expense of fiber support. To minimize the design tradeoff and optimize both support and stability, multi-layer fabrics were developed. For example, in double and triple layer fabrics, the forming side is designed for support while the wear side is designed for stability and drainage.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Essentially, triple layer fabrics consist of two fabrics, the forming layer and the wear layer, held together by binding yarns. The binding is extremely important to the overall integrity of the fabric. One problem with triple layer fabrics has been relative slippage between the two layers which breaks down the fabric over time. In addition, the binding yarns can disrupt the structure of the forming layer resulting in marking of the paper. See e.g., Osterberg (U.S. Pat. No. 4,501,303), the contents of which are incorporated herein by reference. In order to further improve the integrity of the fabric and sheet support, triple layer fabrics were created incorporating binder pairs. These pairs of binders are incorporated into the structure in a variety of weave patterns and picking sequences. See e.g., Seabrook et al. (U.S. Pat. No. 5,826,627) and Ward (U.S. Pat. No. 5,967,195), the contents of which are incorporated herein by reference.

As mentioned above, the fabric is installed as a continuous belt which is rotated through the papermaking machine at considerable speeds. It is important to have a forming fabric with good CD stability to provide acceptable sheet profiles as the operating speeds of papermaking machines increase. This has been accomplished in the prior art with the triple stacked shute (TSS) concept. TSS fabrics add a CD yarn stacked between the forming side shute and the wear side shute to acts as a CD stabilizer. Several closely related patents exist covering triple stacked shute (TSS) designs; e.g. JP 6-4953, U.S. Pat. No. 4,379,735, U.S. Pat. No. 4,941,514, U.S. Pat. No. 5,164,249, U.S. Pat. No. 5,169,709 and U.S. Pat. No. 5,366,798, the contents of which are incorporated herein by reference.

One disadvantage of the TSS concept is that the design adds additional caliper and void volume to the fabric which adversely impacts the efficiency of the vacuum elements in the papermaking machine. This is because the vacuum elements have to rid the fabric voids of water before they start de-watering the paper sheet. Thus, a need exists for a forming fabric that reduces the void volume of the fabric without increasing the caliper.

Furthermore, it is desired that multi-layer fabrics have more cross-directional stability and stiffness to prevent cross directional shrinkage and improve sheet formation and appearance.

The present invention is a multi-layer forming fabric having CD packing yarns added to the wear-side layer. The packing yarns add to the CD stability of the fabric and greatly reduce the void volume without adding to the fabric caliper and not significantly disrupting the air permeability of the fabric.

SUMMARY OF THE INVENTION

Accordingly, the present invention is a forming fabric, although it may find application in the forming, pressing and drying sections of a paper machine.

The present invention is a multi-layer forming fabric having a top layer and a bottom layer of cross-machine direction (CD) wefts. In the case of a double layer fabric, machine-direction (MD) warp yarns weave between the top and bottom layer of weft yarns. In the case of a triple layer fabric, a top warp weaves within the top layer of weft yarns, a bottom warp weaves within the bottom layer of weft yarns, and the two layers are bound together by weft binders or warp binders. The bottom layer has CD packing yarns inserted between adjacent CD weft yarns. These packing yarns reduce the void volume of the fabric without significantly disrupting the air permeability or increasing the caliper of the fabric. The top layer is the forming side of the fabric and the bottom layer is the wear side of the fabric.

Other aspects of the present invention include that the packing yarns also act to increase the CD stability and seam strength of the fabric and reduces the lateral movement of the wear side weft yarns.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawing, in which.

DETAILED DESCRIPTION OF THE PREFERRED EMBODIMENTS

The present invention is a multi-layer papermaker's fabric, usable in the forming section of a paper machine, having a top layer and a bottom layer of cross-machine direction (CD) wefts. The top (forming) layer and bottom (wear side) layer are woven together to form a multi-layer fabric. CD packing yarns are inserted between adjacent wear side weft yarns. The packing yarns effectively reduce the fabric's absolute void volume while not significantly impacting the drainage properties of the fabric. A significant advantage of this fabric is increased vacuum efficiencies on the wet end of a paper machine. The packing yarns accomplish this by filling some of the void on the wear side of the cloth without significantly disrupting the air permeability or increasing the caliper of the fabric. The placement of the packing yarns also adds to the CD stability and seam strength of the fabric and reduces the lateral movement of the wear side weft yarns.

Figure 2:
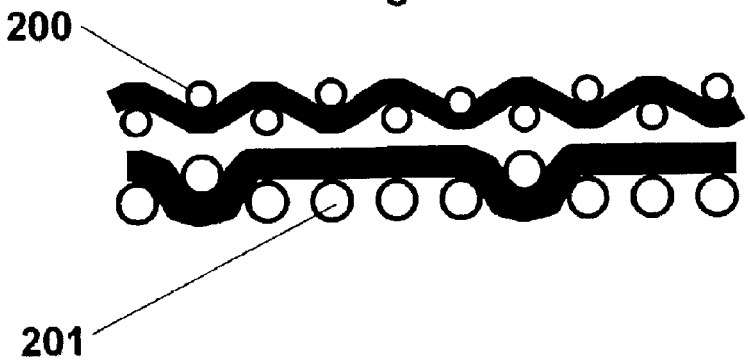
FIG. 2 shows a cross-sectional view of a particular example of a 1:1 weft ratio multi-layer fabric in accordance to the prior art.

Multi-layer forming fabrics exist in many forms. One benefit of multi-layer forming fabrics over single layer fabrics is the ability to use small CD weft yarns in the forming side of the fabric for optimum sheet forming characteristics and larger CD weft yarns in the wear side of the forming fabric for stability and life potential. FIG. 2 is a cross-sectional view of one example of a 1:1 weft ratio multi-layer fabric in accordance to the prior art. There is one smaller forming side weft 200 for every one larger wear side weft 201. This fabric is very dense with a low void volume. Unfortunately, due to the fact that the wear side wefts are a larger diameter than the forming side wefts, the wear side of the cloth "fills up" with weft yarns before the forming side thus not getting the optimum number of forming side wefts for the best possible sheet forming properties.

Figure 3A:
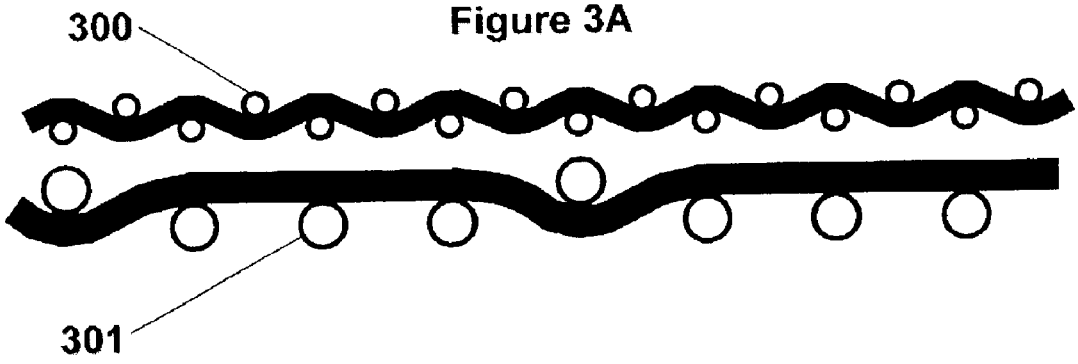
FIGS. 3A and 3B show a) a cross-sectional view of a particular example of a 2:1 weft ratio multi-layer fabric in accordance to the prior art and b) a cross-sectional view of a particular example of a 2:1 weft ratio multi-layer fabric in accordance with the teachings of the present invention.
Figure 3B:
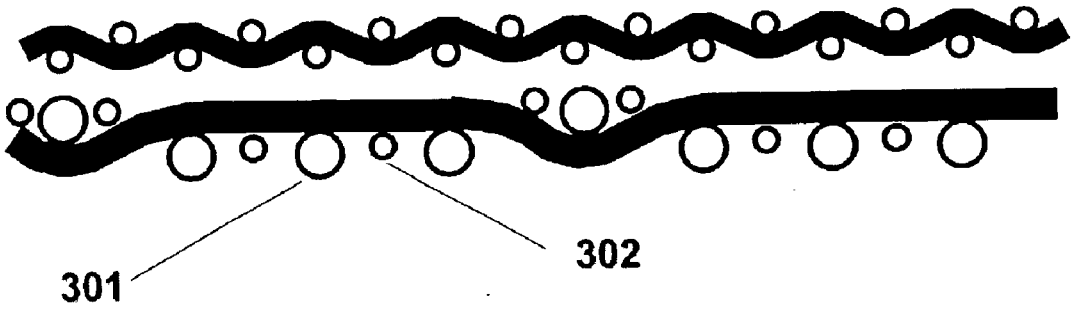

FIG. 3A is a cross-sectional view of one example of a 2:1 weft ratio multi-layer fabric in accordance to the prior art. There are two smaller forming side wefts 300 for every one larger wear side weft 301. One advantage of this fabric over the fabric in FIG. 2 is the ability to add more forming side wefts thus filling the forming side of the fabric first and hence, optimizing the sheet forming properties. Larger yarns can be use in the wear side for added stability and life potential. However, these larger wear side weft yarns add caliper to the fabric and increases the void volume. The fabric in FIG. 3B is similar to the fabric in FIG. 3A but a packing yarn 302, that has a smaller diameter than the wear side wefts, has been added between adjacent wear side wefts. This packing yarn fills some of the void between the wear side wefts thus, reducing the void volume of the fabric. Since the packing yarn is added between adjacent wear side wefts, the caliper of the fabric is not affected.

Figure 1A:
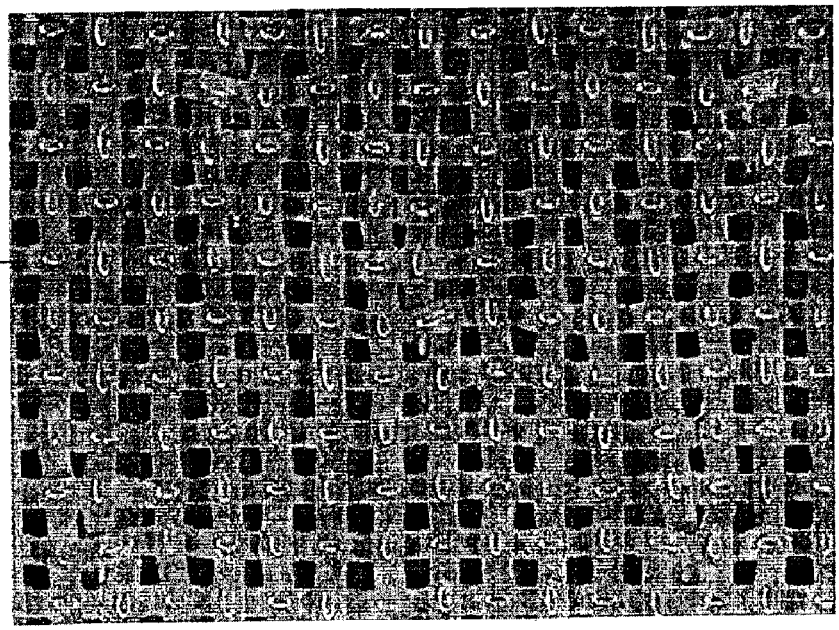
FIGS. 1A and 1B show a) a forming side view and b) a wear side view of a multi-layer fabric woven in accordance with the teachings of the present invention.
Figure 1B:
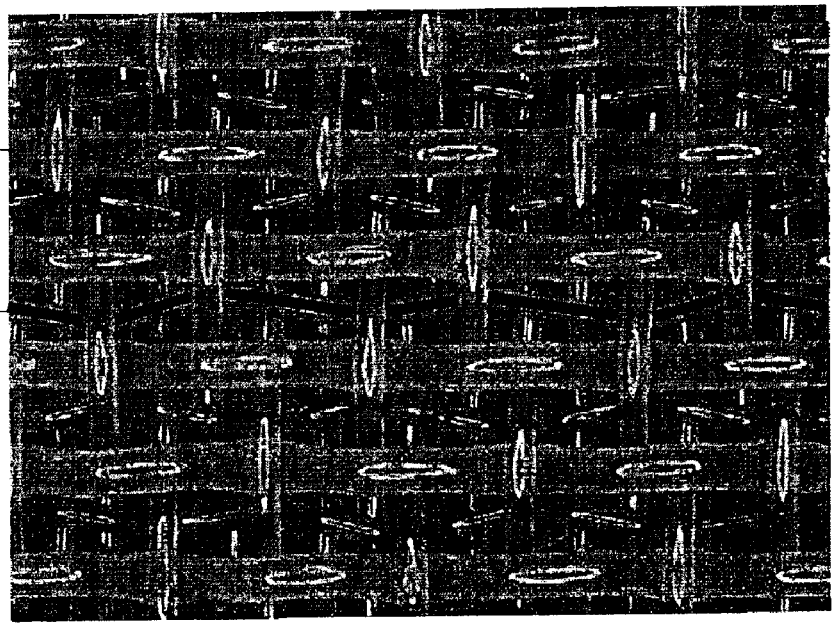

A sample forming fabric has been produced in accordance with the teachings of the present invention. FIG. 1 shows a) a forming side view and b) a wear side view of a fabric woven in accordance with the teachings of the present invention. In FIGS. 1A and 1B, the fabric is displayed such that the MD is in the vertical direction and hence the CD yarns stretch horizontally across the figure. In the sample fabric, the forming side surface shown in FIG. 1A is simply a plain weave pattern. Forming side weft 100 is used to support the fibers and form the sheet of paper. The wear side layer of the fabric has CD packing yarns 102 inserted between each of the wear side CD weft yarns 101. CD packing yarn 102 has been marked in FIG. 1B for emphasis.

The weave pattern shown in FIGS. 1A and 1B is simply one exemplary embodiment of the present invention. The present invention is not to be limited to this pattern, and in fact encompasses many weave patterns.

Figure 4A:
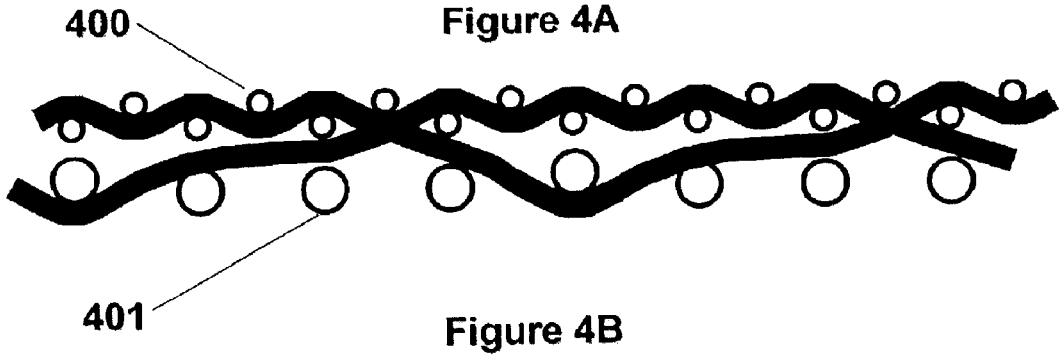
FIGS. 4A and 4B show a) a cross-sectional view of a particular example of a 2:1 weft ratio multi-layer fabric in accordance to the prior art and b) a cross-sectional view of a particular example of a 2:1 weft ratio multi-layer fabric in accordance with the teachings of the present invention.
Figure 4B:
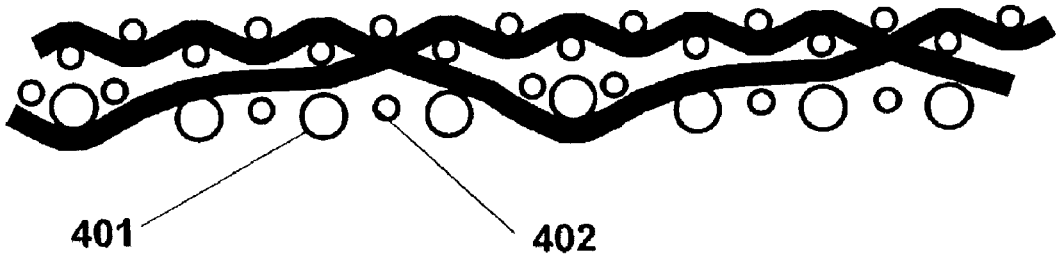
Figure 5A:
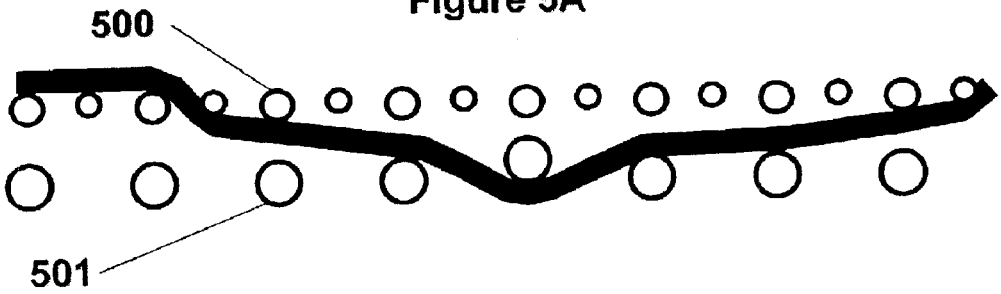
FIGS. 5A and 5B show a) a cross-sectional view of a particular example of a 2:1 weft ratio multi-layer fabric in accordance to the prior art and b) a cross-sectional view of a particular example of a 2:1 weft ratio multi-layer fabric in accordance with the teachings of the present invention.
Figure 5B:
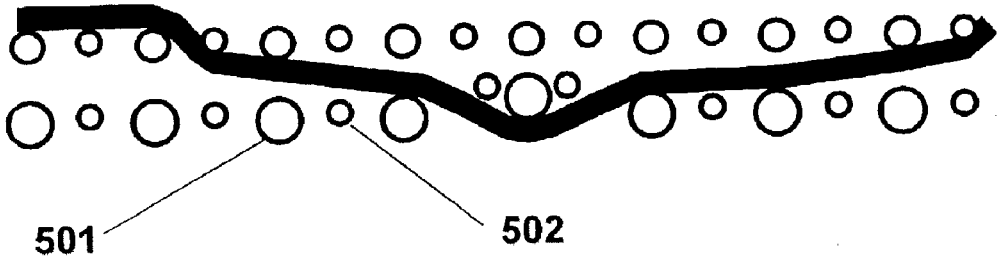

FIGS. 4A and 5A are cross-sectional views of additional examples of 2:1 weft ratio multi-layer fabrics in accordance to the prior art. There are two smaller forming side wefts 400 and 500 for every one larger wear side weft 401 and 501. The fabrics in FIGS. 4B and 5B are similar to the fabrics in FIGS. 4A and 5A respectively but a packing yarn 402 and 502 has been added between adjacent wear side wefts. This packing yarn fills some of the void between the wear side wefts thus, reducing the void volume of the fabric. Since the packing yarn is added between adjacent wear side wefts, the caliper of the fabric is not affected.

The fabric according to the present invention preferably comprises only monofilament yarns, preferably of polyester, polyamide, or other polymer such as polybutylene terephthalate (PBT) or polyethylene napthalate (PEN). Bicomponent or sheath/core yarns can also be employed. Any combination of polymers for any of the yarns can be used as identified by one of ordinary skill in the art. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape. Multi-filaments or cabled yarns can also be used.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a top layer of cross machine-direction (CD) weft yarns and a bottom layer of CD weft yarns are woven together with machine direction (MD) warp yarns to form a multi-layer fabric; and the bottom layer having CD packing yarns, that are smaller in diameter to the bottom layer CD weft yarns, inserted between adjacent CD weft yarns; thereby reducing the void volume of the fabric without significantly disrupting an air permeability or increasing a caliper of the fabric.

2. The papermaker's fabric according to claim 1, wherein the MD warp yarns and the top layer of CD weft yarns form a forming side of the fabric and the MD warp yarns and the bottom layer of CD weft yarns form the wear side of the fabric.

3. The papermaker's fabric according to claim 1, wherein the ratio of forming side CD weft yarns to bottom side CD weft yarns is greater than 1:1.

4. The papermaker's fabric according to claim 1, wherein the top layer is a paper forming layer woven in a plain weave pattern.

5. The papermaker's fabric according to claim 1, wherein the packing yarns increase the CD stability of the fabric.

6. The papermaker's fabric according to claim 1, wherein the packing yarns increase the seam strength of the fabric.

7. The papermaker's fabric according to claim 1, wherein the packing yarns reduce the lateral movement of the wear side weft yarns.

8. The papermaker's fabric according to claim 1, wherein at least some of the MD yarns are one of polyamide, polyester, polybutylene terephthalate (PBT), or polyethylene napthalate (PEN) yarns.

9. The papermaker's fabric according to claim 1, wherein at least some of the CD wefts are one of polyamide, polyester, polybutylene terephthalate (PBT), or polyethylene napthalate (PEN) yarns.

10. The papermaker's fabric according to claim 1, wherein any of the MD warp yarns, CD weft yarns, or packing yarns have a circular cross-sectional shape, a rectangular cross-sectional shape or a non-round cross-sectional shape.

11. The papermaker's fabric according to claim 1, wherein any of the MD warp yarns, CD weft yarns, or packing yarns are multi-filaments or cabled yarns.

* * * * *